United States Patent [19]

Alliger

[11] 4,244,702

[45] Jan. 13, 1981

[54] EMULSIFIED FUEL OIL AND METHOD OF PRODUCTION

[76] Inventor: Howard Alliger, 10 Pondersa Dr., Melville, N.Y. 11746

[21] Appl. No.: 15,442

[22] Filed: Feb. 26, 1979

[51] Int. Cl.[3] ..... C10L 1/04

[52] U.S. Cl. ..... 44/51

[58] Field of Search ..... 44/51; 585/1, 14

[56] References Cited

U.S. PATENT DOCUMENTS 3,846,087 11/1974 Dille et al. ..... 44/51

OTHER PUBLICATIONS

Encyclopedia of Chemical Technology II, vol. 15, p. 81, (1968), Wiley-Interscience.

*Primary Examiner*—Jacqueline V. Howard

*Attorney, Agent, or Firm*—Kenneth S. Goldfarb

[57] ABSTRACT

A fuel oil emulsion and method of production comprising finely divided water in a mixture of #6 bunker oil and #2 diesel oil. From 1 to 20 parts by volume of water and #6 bunker oil are used with 100 parts by volume of #2 diesel oil. The optimum results are attained with about 10 parts by volume each of water and #6 bunker oil with 100 parts of #2 diesel oil.

6 Claims, No Drawings

EMULSIFIED FUEL OIL AND METHOD OF PRODUCTION

BACKGROUND OF THE INVENTION

1. Field of the Invention

This invention relates to fuel oil and more particularly to water in oil emulsions for fuel.

2. State of the Prior Art

Conservation of energy is a national goal and any improvement of combustion processes is obviously of major interest. It has been found that water-in-oil emulsions can improve the burning characteristics of boilers, gas turbines and internal combustion engines. The advantages of this type of fuel are:

reduction of smoke and $NO_x$ emissions;
savings of fuel, on the order of 5%;
less fouling of boiler heat exchange surfaces;
utilization of heavier or less expensive fuels.

The idea of adding water to combustion was mentioned 200 years ago, and adding emulsions to fuel about 80 years ago. During World War II, water was injected into airplane engines for a brief moment in order to obtain a burst of speed. However, in 1947 the addition of finely atomized water to spark ignition engines was recognized as a method of eliminating hard knock or premature detonation. The first evaluation of emulsions was performed on diesel engines in 1952. Recently the focus on energy shortage has hastened emulsion research and two national symposiums have been held by the United States Department of Transportation on emulsified fuels in combustion.

One difficulty in making a useful emulsion is the high requirement of homogenizing energy needed to produce a suitably small particle size, and an emulsion that will not coalesce and "cream out" (emulsion break and settle). This energy can be applied by high speed propeller, ultrasonic probe, vibrating reed or high pressure orifice. For research purposes the fuel oil emulsion is often made in a batch arrangement; a high speed blade homogenizer is typically used. However, in a practical combustion situation, when processing a continuous flow fuel line, homogenizing intensities needed must be even higher than in "beaker processing," since application of energy to any portion of a flowing stream is momentary. With diesel engine fuel in particular, intensities necessary border on the impractical because Diesel #2 oil is inherently difficult to emulsify. Its interfacial tension with water is greater than gasoline, or #4 and #6 oil. When using ultrasonics, cavitation intensity (bubble collapse force) is low because of high vapor pressure and low viscosity (low molecular attraction). Moreover, the higher fuel oil temperature (due to recirculation from the diesel engine) exacerbates the difficulty in making and maintaining the emulsion. Wetting agents or emulsifiers may be added to the mixture, and these are a big aid in producing and stabilizing an emulsion. But, because these additives are expensive and also add an extra step in the process, it is generally preferred to avoid them if possible.

The addition of water to the combustion process has several interesting effects. The most obvious is cooling. Lower temperatures reduce $NO_x$ formation; and in engines, reduce exhaust valve burning and cylinder wall losses. It is not known, however, exactly how water improves combustion efficiency. The most widely considered theory is that of "microexplosions." A properly formulated emulsion will produce a droplet explosion of sufficient violence to produce secondary atomization and micro-mixing. This occurs because the entrained water becomes superheated. The new droplets are more homogeneous and air and fuel mixing is improved requiring less excess air.

There is another more recent theory to explain the benefits of emulsion burning. Water, alcohol, or any other compound which adds more hydrogenthan carbon to the combustion process may produce the same desired results. The water emulsion then, only distributes the hydrogen evenly. The increased hydrogen theory is somewhat borne out by the fact that gasoline engines get increased efficiency from added alsohol as well as water. Since hydrogen in water does not dissociate at normal combustion temperatures, the chemistry explaining this phenomenon is not apparent. Further, engines may work better with increased water, not due to the emulsion as such, but because part of the action is now that of a steam engine which may increase the expansive output per unit of oil fuel. The cooling effect itself of the water might be the important factor; burning is more even with water vapor surrounding the burning oil droplet and less soot is formed.

SUMMARY OF THE INVENTION

The present invention relates to a method of making relatively stable fuel oil emulsions with small inputs of energy and without the addition of wetting agents or surfactants. This method is especially interesting on #2 diesel fuel which will usually not hold its emulsion long enough to be burned without added emulsifiers. Adding a small percentage of #6 oil to the #2 oil permits a fine water/oil emulsion to be made easily. Even a trace of #6 is a big aid; and the more #6 added the better and faster the emulsion.

DETAILED DESCRIPTION OF THE INVENTION

In accordance with the concepts of this invention a range of between 1 to 20 parts by volume of water is added to 100 parts by volume of #2 diesel oil which has between 1 and 20 parts of #6 bunker oil added thereto.

If 10% water (by volume) is to be added to the #2 fuel oil as an ideal ratio, about 10% #6 also added will permit a micro emulsion to be formed—an emulsion that will not noticably settle out or separate. This is an optimum emulsion. This submicron emulsion can otherwise be formed only with more than 5% pure wetting agent added to the system. Without wetting agent added, there is probably no amount of energy that can produce a stable emulsion with any fuel oil.

It is suspected that the smaller or finer the emulsion, the better will be the combustion improvement. It is possible too, that this fuel oil microemulsion can be manufactured at a central location or refinery, then stored and shipped when needed rather than produced on location just before burning. Initial research indicates that a combination of #6 oil addition as well as high homogenizing intensities will produce a solubilizing of water within the #2 fuel oil, rather than a dispersion or emulsion. Because of the opaque mixture it is difficult to distinguish between a micro emulsion and a true solution. It remains to be seen whether a water "solution" further improves burning characteristics over that of a microemulsion.

The mixing of different types of fuels, called hybrid fuels, is not new. However, it is practiced for the purpose of using the cheapest possible combination that will burn, never as an aid in mixing water into the fuel. The heavy and unrefined #6 oil would never be added by combustion improvement. The small addition of #6 oil in this invention does not appreciably change the viscosity of the #2 oil. Diesel engines which traditionally can run on less than ideal fuels should not be adversely affected by this addition, especially with the improvement of burning characteristics due to the emulsion.

It is known that emulsifying water into #4 and #6 oil is easier and longer lasting than lighter fuels such as #2 or gasoline. This is possibly due to the higher viscosity which inhibits coalescence or sedimentation of the water droplets, or due to the impurities in the heavier fuels which coat the interface between oil and water, lowering interfacial tension similar to a wetting agent. Coal or carbon particles is known to do this. But emulsifying #6 oil and water, although easier than emulsifying #2 oil, will fairly quickly have a separation of phases. Surprisingly and unexpectedly, this invention, emulsifying #2 with #6 and water, mixed in the same way, will have far less separation or none at all with high homogenizing intensities.

If an ordinary emulsion is made with #2 oil, and say, 1% wetting agent, in a few minutes 4 separate phases may be observed in a test tube. On the top will be pure #2 oil, below this the water in oil emulsion, below this an oil-in-water emulsion, and on the bottom, pure water. This type of separation does not take place when adding #6 oil and water to #2 oil instead of an emulsifier. If a small amount of #6 is added (less than ideal), and vigorously hand shook, after a few hours some pure water will separate out at the bottom. If more #6 is added and small amounts of ultrasonic homogenizing, in a few days an oil in water phase will sediment out. This phase will be highly viscous—much more so than the original #6 oil. If about equal volumes of water and #6 oil is added and ultrasonically homogenized with moderate intensity, after a week, a faintly noticeable oil-in-water separation will take place only slightly more viscous than the main body. Thus adding more of the "viscous" #6 oil apparently produces a less viscous separation.

Because #6 oil is less costly than #2 and has more heating value, this invention in effect greatly reduces the cost of producing an emulsion both from the standpoint of less homogenizing energy needed, as well as obviating the necessity for emulsifiers.

What is claimed is:

1. An emulsified fuel oil comprising 100 parts by volume of #2 diesel oil, 1 to 20 parts by volume of water, and 1 to 20 parts by volume of #6 bunker oil.

2. An emulsified fuel oil according to claim 1, wherein there is substantially the same amount of water as there is #6 bunker oil.

3. A emulsified fuel oil comprising 100 parts by volume of #2 diesel oil, 10 parts by volume of water, and 10 parts by volume of #6 bunker oil.

4. A method of making an emulsified fuel oil without requiring a wetting agent comprising the steps of adding substantially equal parts of water and #6 bunker oil to #2 diesel oil, and then applying energy to separate the water to a small particle size.

5. A method according to claim 4 wherein from 1 to 20 parts by volume of water and #6 bunker oil are added to 100 parts by volume of #2 diesel oil.

6. A method according to claim 4, wherein about 10 parts by volume of water and #6 bunker oil are added to 100 parts by volume of #2 diesel oil.

* * * * *